US005761914A

United States Patent [19]

Carey et al.

[11] Patent Number: 5,761,914

[45] Date of Patent: Jun. 9, 1998

[54] OIL RETURN FROM EVAPORATOR TO COMPRESSOR IN A REFRIGERATION SYSTEM

[75] Inventors: Michael D. Carey, Holmen; Sean A. Smith, La Crosse, both of Wis.

[73] Assignee: American Standard Inc., Piscataway, N.J.

[21] Appl. No.: 801,545

[22] Filed: Feb. 18, 1997

[51] Int. Cl.[6] ..... F25B 43/02

[52] U.S. Cl. ..... 62/84; 62/471; 62/231; 62/157

[58] Field of Search ..... 62/84, 85, 157, 62/158, 196.1, 197, 231, 468, 469, 470, 471

[56] References Cited

U.S. PATENT DOCUMENTS

| | | | |
|---|---|---|---|
| 2,246,845 | 6/1941 | Durden | 62/115 |
| 4,715,196 | 12/1987 | Sugiura | 62/468 |
| 4,843,837 | 7/1989 | Ogawa et al. | 62/471 |
| 4,918,944 | 4/1990 | Takahashi et al. | 62/471 |
| 5,086,621 | 2/1992 | Starner et al. | 62/84 |
| 5,165,248 | 11/1992 | Sishtla | 62/84 |
| 5,561,987 | 10/1996 | Hartfield et al. | 62/471 |

*Primary Examiner*—John M. Sollecito
*Attorney, Agent, or Firm*—William J. Beres; William O'Driscoll; Peter D. Ferguson

[57] ABSTRACT

A refrigeration system employing a screw compressor and a falling film evaporator makes use of high-side pressure to drive lubricant, which escapes the compressor and collects as a lubricant-rich mixture of lubricant and refrigerant in the system evaporator, back to the compressor. The mixture is cyclically exposed to high-side pressure for a period of time which (i) varies in accordance with the difference between a sensed condenser-related pressure and a sensed evaporator-related pressure and (ii) is calculated to maintain a predetermined oil concentration in the lubricant-rich mixture in the evaporator so as to minimize the parasitic losses to system efficiency associated with the oil return process.

36 Claims, 5 Drawing Sheets

OIL RETURN FROM EVAPORATOR TO COMPRESSOR IN A REFRIGERATION SYSTEM

BACKGROUND OF THE INVENTION

The present invention is directed to the return of oil, which is carried downstream and out of a refrigeration compressor in the discharge gas flow stream to the system evaporator, back to the compressor. More particularly, the present invention is directed to the cyclic return of oil from a falling film evaporator in a screw compressor-based refrigeration chiller system by the use of and in accordance with then-existing differential pressures within the system, all in a manner which minimizes the parasitic losses to system efficiency associated with the oil return process.

The entrainment of oil in the stream of compressed refrigerant gas discharged from a compressor in a refrigeration system and the need to return that oil to the compressor for lubricating purposes is an age old problem and has been addressed in many ways. With the advent of commercial use of screw compressors in such systems and the demand for ever higher system efficiencies, the need for optimized oil return apparatus and methodology has become all the more critical for the reason that screw compressors, by their nature, circulate a much higher percentage of oil in their discharge gas flow streams than was the case in previous systems.

Screw compressors have come to be used in refrigeration systems due to their ability to be part-loaded over a wide capacity range and in a continuous manner by use of a capacity control slide valve. In previous systems, unloading was most often in a stepwise fashion which is nowhere near as efficient as the load-matching made available over a continuous capacity range through the use of a screw compressor having slide valve capacity control.

Screw compressors, in operation, employ rotors which are disposed in a working chamber. Refrigerant gas at suction pressure enters the low pressure end of the compressor's working chamber and is enveloped in a compression pocket formed between the counter-rotating screw rotors and the wall of the working chamber in which they are disposed. The volume of such a compression pocket decreases and the pocket is circumferentially displaced to the high pressure end of the working chamber as the rotors rotate and mesh. The gas within such a pocket is compressed and heated by virtue of the decreasing volume in which it is contained until such time as the pocket comes into communication with a discharge port defined in the high pressure end of the working chamber.

In many applications, oil is injected into the working chamber of screw compressors (and therefore into the refrigerant gas being compressed) in relatively large quantities and for several reasons. First, injected oil acts to cool the refrigerant gas undergoing compression which, in turn, causes the rotors to run cooler. This allows for tighter tolerances between the rotors from the outset.

Injected oil also acts as a lubricant. One of the two rotors in a twin screw compressor is typically driven by an external source such as an electric motor. The mating rotor is driven by virtue of its meshing relationship with the externally driven rotor. Injected oil prevents excessive wear between the driving and driven rotors. Oil is additionally delivered to various bearing surfaces within the compressor for their lubrication and is used to reduce compressor noise.

Finally, oil injected into the working chamber of a screw compressor acts as a sealant between the edge and end surfaces of the individual screw rotors and between the rotors themselves and the walls of the working chamber in which they are disposed. There are no discrete seals between those elements and surfaces and absent the injection of oil, significant leakage paths would exist internal of the working chamber of a screw compressor which would be highly detrimental to compressor and overall system efficiency. In sum, oil injection both increases the efficiency and prolongs the life of a refrigeration screw compressor.

Oil making its way into the working chamber of a screw compressor ends up, for the most part, being entrained in the form of atomized liquid droplets in the refrigerant gas undergoing compression therein. Such oil must be removed from the oil-rich refrigerant gas which discharged from the compressor in order to make it available for return to the compressor for the purposes enumerated above.

In typical screw compressor-based refrigeration systems, compressor lubricant may comprise on the order of 10% by weight of the compressed refrigerant gas discharged from the compressor and despite the availability and use of 99.9% efficient oil separators, 0.1% of the lubricant available to a screw compressor is continuously carried out of the compressor-separator combination and into downstream components of the refrigeration system. Such lubricant typically makes its way to the low-side of the refrigeration system and concentrates in the system evaporator. The low-side of a refrigeration system is the portion of the system which is downstream of the system expansion valve but upstream of the compressor where relatively low pressures exist while the high-side of the system is generally downstream of the compressor but upstream of the system expansion valve where pressures are relatively much higher.

It will be appreciated that despite the high efficiency of the oil separators used in such systems, a compressor will lose a significant portion of its lubricant to the downstream components of the refrigeration system over time. Failure to return such oil to the compressor will ultimately result in compressor failure due to oil starvation.

In some screw compressor-based refrigeration systems, so-called passive oil return has been used to achieve the return of oil from the system evaporator to the compressor. Passive oil return connotes use of parameters, characteristics and conditions which are inherent in the normal course of system operation, such as the velocity of suction gas, to carry or drive oil from the system evaporator back to the system compressor without the use of "active" components such as mechanical or electromechanical pumps, float valves, electrical contacts, eductors or the like that must be separately or proactively energized or controlled in operation.

The use of eductors for oil return has been fairly common in the past. An eductor makes use of the differential pressure between the high-side and the low-side of the refrigeration system to draw oil from the evaporator back to the system compressor. Such differential pressures, in previous systems have typically been sufficient to drive the oil return process over the operating ranges of such systems.

Advent of the use of so-called falling film evaporators in refrigeration systems renders passive oil return essentially impossible. Additionally, it makes active return by the use of an eductor, difficult to achieve because differential pressures between the high-side and the low-side of systems employing such evaporators are not reliably large enough over the entire range of system operating conditions to draw or drive oil from the evaporator for return to the compressor without the use of multiple eductors. The use of multiple eductors to achieve oil return brings cost and control issues into play that render their use for oil return non-viable. Another factor making the use of eductors difficult in current systems and those of the future is the relatively recent and much more prevalent use of lower pressure refrigerants than has been the case in the past. Further, requirements to enhance the overall efficiency of screw compressor-based refrigeration systems and to reduce the size of both the refrigerant and lubricant charges in such systems so as to achieve economies relating to the cost of the refrigerant and lubricant system constituents have come to bear.

As a result, demands have been imposed on system design relating not only to achieving the successful return of lubricant to the compressor (when a smaller amount is available within the system to start with) but return which is controlled and accomplished in a manner which minimizes the parasitic system efficiency losses associated with the oil return process. The parasitic loss associated with the oil return process include a negative effect or loss of compressor capacity and increased power consumption by the compressor.

With respect to system efficiency, eductors can impose anywhere from approximately a 1% to 2% penalty on system efficiency by their operation with the efficiency penalty being largest when the system operates at part load (which screw compressor-based systems often do). As such and in view of the fact that they may not operate to required levels of performance over the entire range of system operating conditions, eductors are not a viable candidate for use in refrigeration systems which employ screw compressors and falling film evaporators even though they are mechanically simple and are essentially maintenance free.

One active rather than passive system and methodology for evaporator to compressor oil return in a refrigeration system involves the use of a so-called gas pump wherein the relatively large pressure differential between the high-side and low-side of the system is used to drive lubricant from the evaporator back to the compressor. Exemplary of such a system is the one described in U.S. Pat. No. 2,246,845 to Durden. Durden teaches a reciprocating compressor-based refrigeration system which makes use of an accumulator tank to store a lubricant-rich mixture received from the evaporator until such time as a separate container, incorporating a float mechanism, fills with the same lubricant-rich mixture. Filling of the float tank is indicative that the separate accumulator is likewise filled.

When the float tank fills, the float lifts and contact is made in an electrical switch mechanism that energizes a solenoid-type valve which admits pressure from the system condenser to the accumulator. Condenser pressure then drives the lubricant-rich mixture out of the accumulator through a thermostatic expansion valve. The expansion valve controls the flow rate of the mixture into an oil rectifying tank and rectified lubricant is returned to the compressor suction line. Rectification is necessary in the Durden system to prevent the return of slugs of liquid to the compressor which, in the case of reciprocating compressor, is potentially damaging.

Oil return in Durden occurs as a result of the filling of both the accumulator and float tank. The period of time during which the Durden accumulator empties is a function of the speed of the rectification process which, in turn, is controlled by the thermostatic expansion valve that restricts flow out of the accumulator in accordance with a temperature sensed in the lubricant return line downstream of the rectifier tank. Oil return apparently occurs in Durden without regard to the effect of the oil return process on system efficiency.

Referring now to U.S. Pat. No. 5,561,987, assigned to the assignee of the present invention and incorporated herein by reference, a screw compressor-based refrigeration system is described which, due to its employment of a falling film evaporator, makes use of an active oil return system. In the system illustrated in the '987 patent, a mechanical pump is disposed in a lubricant recovery line for the purpose of pumping lubricant-rich refrigerant from the evaporator to the suction line of the compressor. Although such pumps do not contribute significantly to system efficiency loss (they bring with them system efficiency losses on the order of from 0.1% to 0.2% depending upon the capacity at which the system is operating), such pumps and associated apparatus must be controlled in accordance with some criteria, and, more significantly, impose a large expense, both from an initial cost standpoint and from the standpoint that they are subject to breakdown, wear and maintenance requirements. As such, use of a mechanical pump or other apparatus employing moving parts which tend to break or wear in the return of oil to a compressor in refrigeration systems brings with it significant disadvantages in many respects.

Referring to Drawing FIGS. 1 and 2 found herein, the parasitic effect of oil return on overall system efficiency is illustrated. Among the inherent parasitic effects associated with oil return and systems in which oil return flow rates are high are losses in compressor capacity and increases in the power used by the compressor. Both adversely effect system efficiency.

Referring first to FIG. 2, system efficiency losses associated with the use of both an eductor-based oil return system and an electromechanical pump-driven oil return system are illustrated. It will be noted that system efficiency losses increase dramatically with the oil return flow rate and that eductor losses are significantly higher and increase more rapidly than the pump-related losses.

Referring to FIG. 1, a comparison of oil return flow rate to oil concentration in the system evaporator is illustrated. As will be apparent from that figure, the higher the oil concentration in the mixture returned from the evaporator to the system compressor, the lower the oil return rate need be. It will be remembered that the lower the oil return rate, the lower will be the system efficiency loss associated with the oil return process. In sum, oil return systems having low return rates least penalize system efficiency.

Because the potential for passive oil return in a refrigeration system in which a screw compressor and a falling film evaporator are used is low or, in some systems, nonexistent, the use of active oil return in such a system is mandated. The need therefore exists for a controlled, active oil return system and methodology for screw compressor-based refrigeration systems in which a falling film evaporator is employed that minimizes the penalties to system efficiency associated with the oil return process yet avoids the cost, reliability and maintenance problems associated with previous active oil return systems.

SUMMARY OF THE INVENTION

It is an object of the present invention to provide active oil return apparatus and methodology for a screw compressor-based refrigeration system employing a falling film evaporator in which the oil return flow rates are kept low so as to minimize the parasitic losses to chiller efficiency associated with the oil return process.

It is another object of the present invention to provide active oil return apparatus and methodology in a screw compressor-based refrigeration system where the return of oil to the compressor is achieved in cycles with each cycle being comprised of a fill portion and a drain portion, the drain portion of each cycle being of a length determined in accordance with the then-existing pressure difference between the system condenser and the system evaporator.

It is still another object of the present invention to provide active oil return apparatus and methodology in a screw compressor-based refrigeration system using high-side pressure to drive oil back to the compressor where oil return is achieved in cycles the length of which vary in accordance with the then-existing load on the refrigeration system.

It is a further object of the present invention to provide for the controlled return of lubricant to a screw compressor from a falling film evaporator in a refrigeration system in a manner which maintains a predetermined average oil concentration in the system evaporator and which optimizes heat transfer in the evaporator while providing for the return of oil to the compressor at a rate which ensures the availability of a sufficient supply of oil to the compressor.

It is still another object of the present invention to provide an active oil return system for a screw compressor-based refrigeration system employing a falling film evaporator which avoids the initial and continuing cost, reliability, breakdown, wear and maintenance issues and disadvantages associated with previous active oil return apparatus and methods yet which minimizes the efficiency penalties imposed on the refrigeration system by previous passive oil return systems.

These and other objects of the present invention, which will be appreciated when the following Description of the Preferred Embodiment and attached Drawing Figures are considered, are achieved by the use of a collection tank into which liquid refrigerant having a relatively high concentration of oil drains from a falling film evaporator in a refrigeration system. Refrigerant gas from the system condenser is cyclically admitted to the collection tank to flush oil back to the compressor for a period of time which varies during each cycle in accordance with the difference in the pressures in the system condenser and system evaporator. Those pressures vary over time in accordance with the then-existing load on the system. The length of each cycle can also be caused to vary, in an enhanced version of the preferred embodiment, in accordance with the then-existing load on the refrigeration system. Varying of the length of an individual oil return cycle in accordance with the load on the system even moreso optimizes the oil return process by still further minimizing the parasitic effects of the oil return process on overall system efficiency.

By controlling the length of time that condenser pressure is admitted to the collection tank during each cycle so as to empty it in accordance with the conditions under which the refrigeration system is then operating, the rate of return of lubricant to the system compressor can be maintained low. The low rate of return achieved by the apparatus and methodology of the present invention minimizes the parasitic losses to system efficiency associated with the oil return process while eliminating the cost and reliability disadvantages associated with previous active oil return systems. By additionally controlling the length of each oil return cycle in accordance with the then-existing load on the refrigeration system in the further enhanced version of the preferred embodiment, efficiency of the refrigeration system can still further be improved as a result of the additional decrease in the parasitic system efficiency losses that will result from the oil return process.

DESCRIPTION OF THE PREFERRED EMBODIMENT

Figure 3:
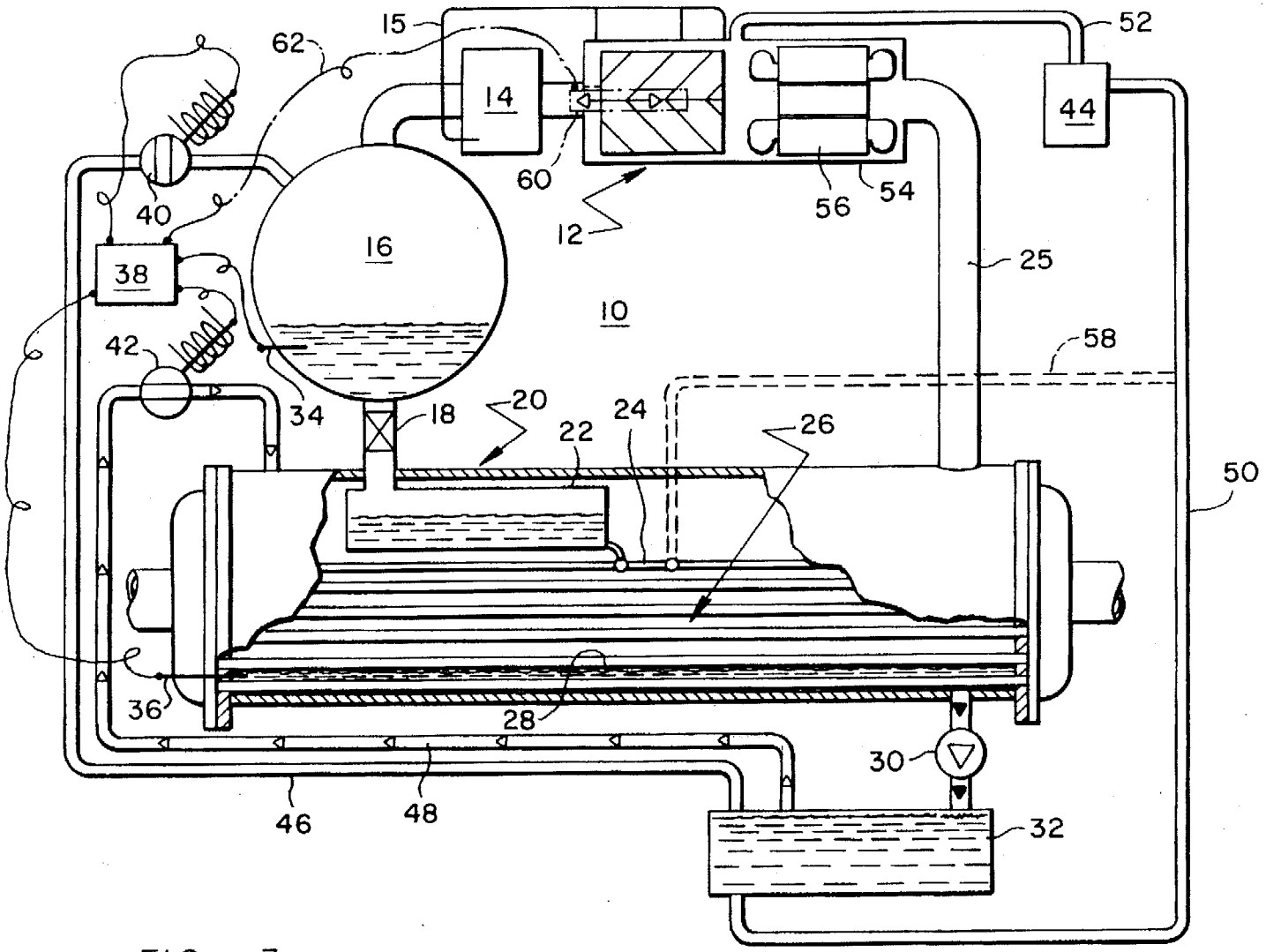
FIG. 3 is a schematic view of a refrigeration chiller employing a screw compressor and a falling film evaporator and illustrating the position of system components as the collection tank fills with lubricant-rich mixture.
Figure 4:
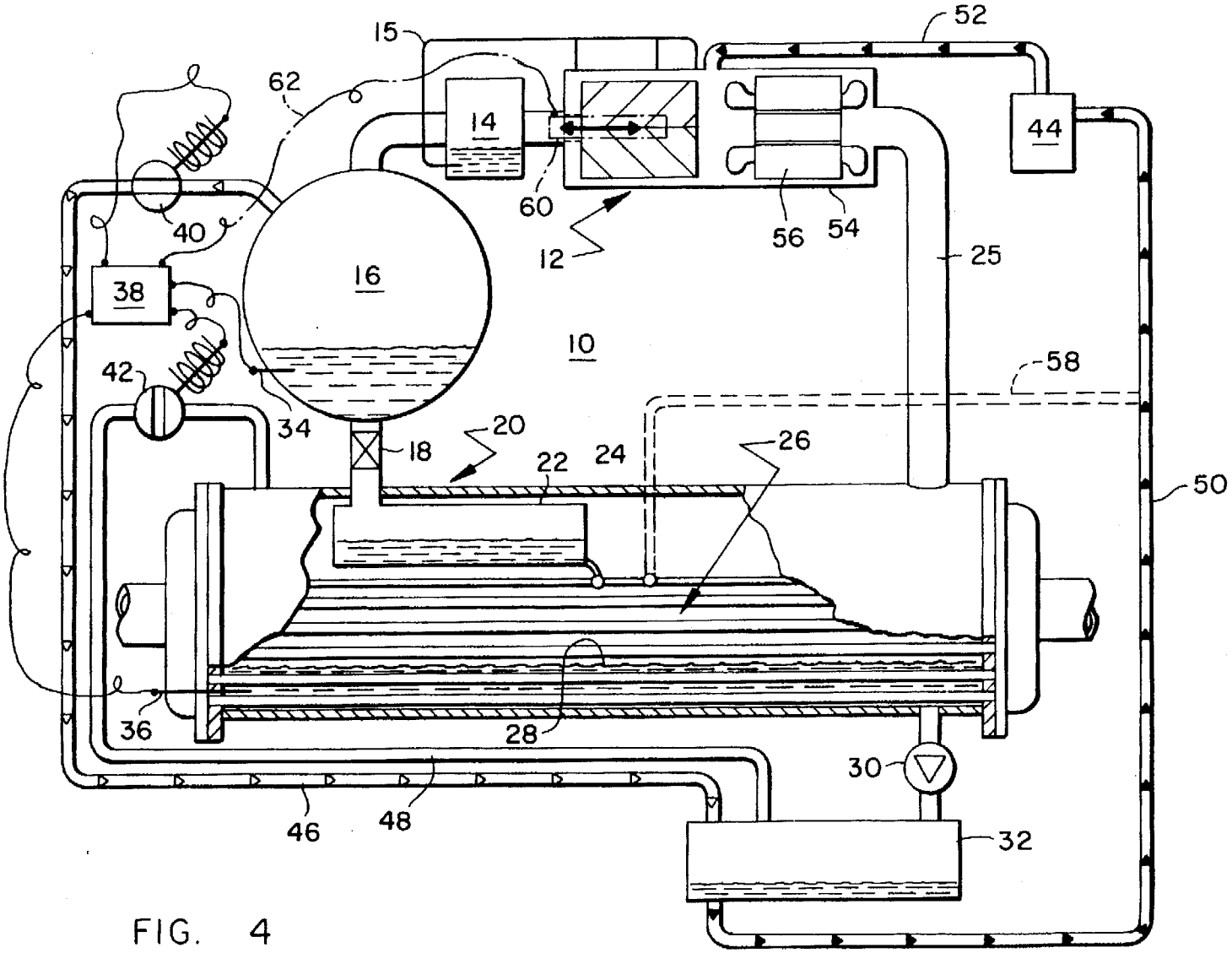
FIG. 4 is the same as FIG. 3 other than in its illustration of the position of system components as the collection tank empties.

Referring now to FIGS. 3 and 4, refrigeration chiller system 10 includes a screw compressor 12 which discharges a refrigerant gas stream in which a significant amount of lubricant is entrained to an oil separator 14 in the form of atomized liquid droplets. Oil separator 14 is a high efficiency separator which permits only a relatively very small amount of lubricant received from the compressor (on the order of 0.1%) to escape and flow downstream to condenser 16. Separated oil is returned to the compressor via a return line 15, driven, in the preferred embodiment, by discharge pressure.

Refrigerant gas condenses in condenser 16 and pools at the bottom thereof along with the lubricant which is carried into the condenser. Liquid refrigerant flows out of condenser 16 carrying such lubricant with it and passes through expansion valve 18. Expansion valve 18 is, in the preferred embodiment, an electronic expansion valve. The refrigerant-lubricant mixture next flows into evaporator 20 in the form of a two-phase mixture which consists primarily of a liquid phase. Evaporator 20, in the preferred embodiment, is a so-called falling film evaporator although the present invention likewise has application in systems employing so-called sprayed evaporators.

Falling film evaporator 20, which can be in the nature of the one described in the '987 patent, incorporated hereinto above, will have a vapor-liquid separator 22 associated with it. Separator 22 delivers liquid refrigerant to distribution device 24 and directs refrigerant vapor out of the evaporator through compressor suction line 25 back to compressor 10. Separator 22 may be disposed within evaporator 20 in the manner described in the '987 patent or it may be disposed as a separate component exterior of the evaporator.

Distribution device 24 is preferably in close proximity to and immediately above the uppermost portion of tube bundle 26 within evaporator 20. As is noted in the '987 patent, a slight hydrostatic head is allowed to develop within the vapor-liquid separator. This permits the flow of saturated liquid out of the separator and into the distribution device without flashing which, in turn, promotes and enhances the uniform distribution of liquid refrigerant (and any lubricant entrained therein) to and over tube bundle 26 through which a heat transfer medium, such as water, flows.

The mixture of liquid refrigerant and lubricant so distributed is deposited and forms as a film of liquid on the upper tubes of tube bundle 26. Tube bundle 26 is configured such that any liquid refrigerant not vaporized by initial contact with a tube in the upper portion of the tube bundle falls into contact with a lower tube in the bundle. Due to its characteristics, the lubricant portion of the mixture will not vaporize but will flow downwardly in liquid form and settle in the lower portion of the evaporator. The end result is much more efficient heat transfer (refrigerant vaporization) in the evaporator and a relatively lubricant-rich pool of liquid refrigerant 28 at the bottom of the evaporator than is the case in previous evaporators. The liquid pool at the bottom of the evaporator is of significantly less volume than the liquid pools in previous evaporators wherein the majority of the tube bundle, by design, is completely immersed in liquid refrigerant. As a result, the quantity of refrigerant used by the system can be significantly reduced.

The level of the lubricant-rich pool of liquid refrigerant 28 at the bottom of the evaporator is preferably maintained such that approximately 5% of the tubes in tube bundle 26 are immersed therein. This level is such that the concentration of lubricant within the liquid refrigerant is maintained constant at approximately 8% through the use of the oil-return system and methodology that will subsequently be more thoroughly described.

Figure 2:
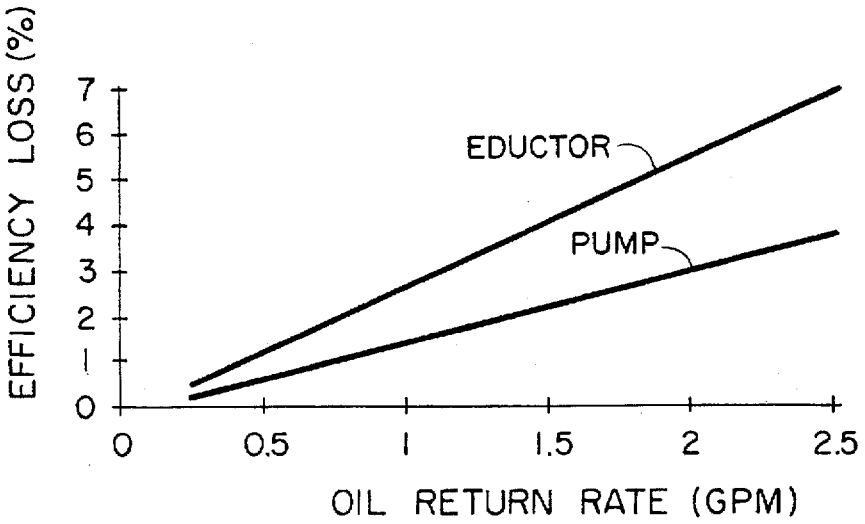
FIGS. 1 and 2 graphically illustrate the effect of oil concentration in the system evaporator on oil return rate and the effect of oil return rate on overall refrigeration system efficiency.

As was noted earlier with respect to FIG. 1, the higher the concentration of lubricant in the pool 28 at the bottom of an evaporator, the lower the oil return rate out of the evaporator can be. It was further noted, referring to FIG. 2, that the lower the oil return rate is, the lower will be the parasitic losses experienced by the refrigeration system as a result of the oil return process.

In the preferred embodiment, which is premised on a refrigeration chiller having a nominal 400 ton refrigeration capacity, the oil concentration level in the evaporator pool is chosen to be maintained in the proximity of 8% due to the fact that at higher concentrations the lubricant in the mixture will tend to froth and foam and such foam will tend to blanket additional tubes in the tube bundle 26. The blanketing of additional tubes by lubricant foam reduces the ability of those tubes to transfer heat from the heat transfer medium flowing through them to the system refrigerant. An efficiency penalty therefore comes into play if, in the preferred embodiment, oil concentration in the liquid pool in the evaporator is permitted to exceed 8%.

Figure 1:
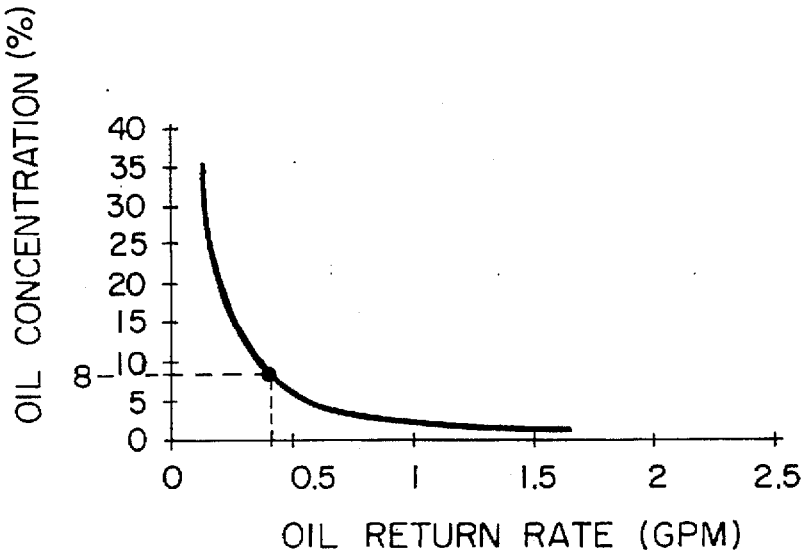

Once the permissible maximum lubricant concentration level for a particular refrigeration system is identified, the lowest lubricant return rate that can be permitted to occur in order to maintain that lubricant concentration level in the evaporator is determined. Referring to FIG. 1, it will be appreciated that if an 8% maximum concentration of lubricant in the liquid refrigerant pool in the bottom of the evaporator is established, the lowest lubricant return rate that can be permitted to occur is a relatively very low 0.46 gallons per minute. Therefore, lubricant return in the present invention is premised on a desire to approach the 0.46 gallon per minute oil return rate within the confines and constraints of the apparatus and methodology used to achieve such return and in view of the fact that the lower the return rate can be maintained over the system operating range, the lower will be the resulting parasitic losses to system efficiency.

Referring back now to FIGS. 3 and 4, the lubricant-rich pool of liquid refrigerant 28 in the falling film evaporator is permitted to drain through check valve 30 into collection tank 32 which, depending on the particular refrigeration system and its application, may be thermally insulated. The capacity of collection tank 32 is relatively small and in the preferred embodiment is chosen to be approximately one gallon.

Once the size of tank 32 is chosen, the rate at which the tank will empty in accordance with the pressure used to "flush" it is determined. For purposes of the present invention, the term "flush" rather than "drain" is in many respects more appropriate, since the collection tank is emptied by pressure, although the terms will be used interchangeably herein.

Figure 6:
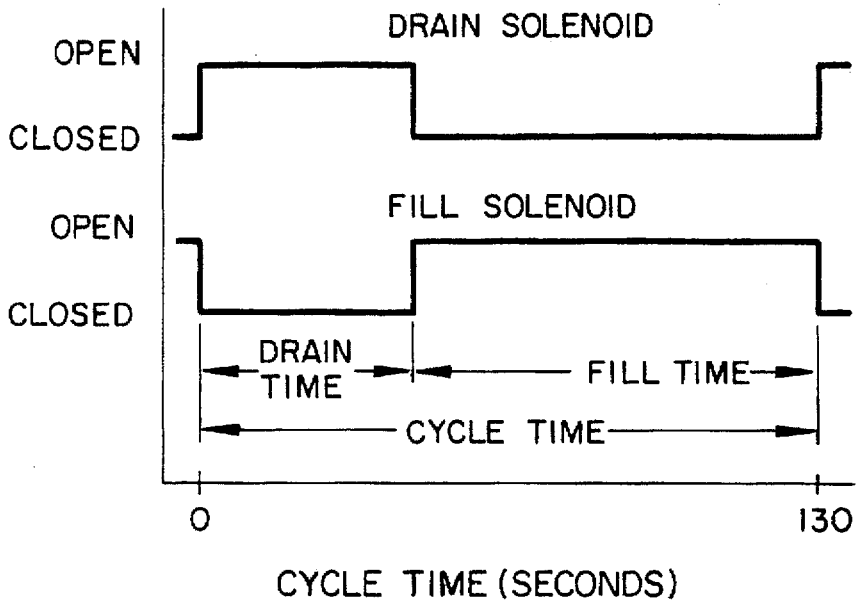
FIGS. 5 and 6 graphically illustrate the time-based positions of the fill and drain solenoids associated with the oil return system of the present invention as well as the relationship of drain time to the then-existing pressure differential between the system condenser and system evaporator.
Figure 5:
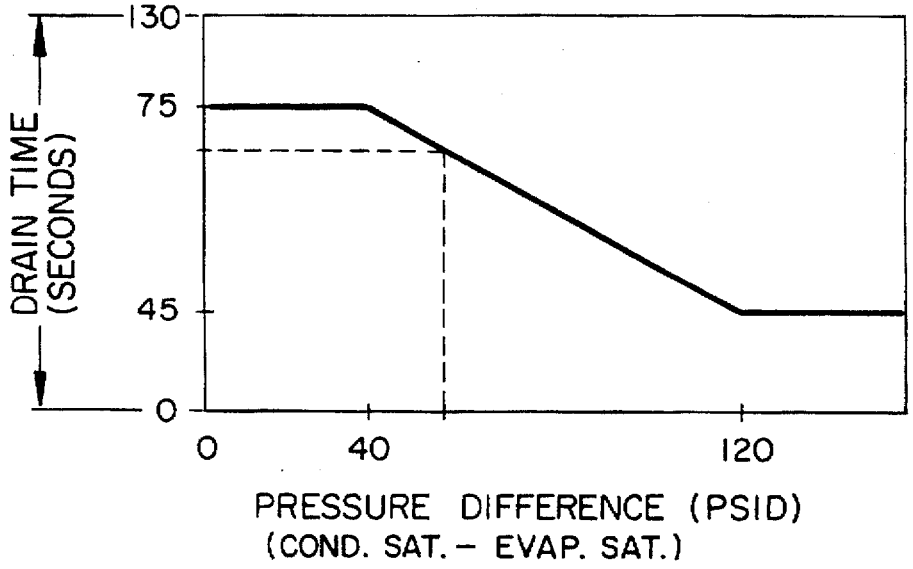

Referring to FIGS. 5 and 6 and as will subsequently more thoroughly be described, the higher the pressure differential between the condenser and collection tank (which, given their flow communication, will be at the same pressure as the evaporator), the shorter will be the amount of time (the "drain time") it will take to flush the collection tank and the longer will be the fill portion of the oil return cycle. From FIG. 5 it will be noted that the range of pressure differences that will be available and/or used to flush the collection tank in the system of the preferred embodiment will, depending upon the circumstances and conditions under which the system is operating, vary from 40 to 120 PSI. At a differential pressure of 40 PSI, the time during which a one gallon tank will empty is 75 seconds while the time during which that same tank will empty at a 120 PSI differential is 45 seconds. Cutoff of the collection tank from condenser pressure coincident with its emptying is necessary to minimize the amount of refrigerant gas that bypasses the system evaporator as a result of the lubricant return process, such bypass being a penalty to system efficiency.

Given a one gallon capacity collection tank and a desire to return a weighted average of 0.46 gallons per minute of oil to the compressor, an oil return cycle time is defined by dividing the one gallon capacity of the collection tank by the 0.46 gallon per minute desired weighted average oil return rate. The result of that calculation identifies that in order to obtain the 0.46 gallon per minute weighted average return rate out of a one gallon tank, the overall oil return cycle time should be 2.17 minutes or 130 seconds.

Once the cycle time has been established, the then-existing pressures in condenser 16 and evaporator 20 are used to control the rate within the cycle at which the collection tank 32 is emptied in accordance with FIGS. 5 and 6. In that regard, temperature sensor 34 senses the temperature of the saturated liquid refrigerant in condenser 16 while sensor 36 senses the temperature of the saturated liquid pooled at the bottom of evaporator 20. Those temperatures are converted by controller 38 to condenser and evaporator-related pressures, their difference is calculated, and the fill solenoid 42 is caused to close and the drain solenoid 40 is caused to open for the period of time indicated in FIG. 5. The use of sensed saturated liquid temperatures is convenient and comes at essentially no cost because these temperatures are already sensed and used for other control purposes in the context of the preferred refrigeration system.

Opening of the drain solenoid during any given cycle causes collection tank 32 to empty and be "flushed" through filter 44 back to compressor 12 in an amount of time which, once again, varies in accordance with the then-existing pressure differential between the condenser and evaporator. That rate, however, remains low as do the efficiency penalties imposed by the oil return process. Further, the oil return process according to the apparatus and methodology of the present invention occurs without the need for components such as pumps, float valves, float tanks, electrical contacts or rectification apparatus, all of which come at significant expense, are subject to failure and wear and which too often need repair or maintenance.

Mechanically speaking, the flushing of oil from tank 32 back to compressor 12 is achieved by the opening of drain solenoid 40 which admits refrigerant gas at condenser pressure to collection tank 32. Such pressure seats check valve 30 and acts against closed fill solenoid 42 which is connected to tank 32 by vent conduit 48. Lubricant-rich fluid is thus forced out of collection tank 32 via conduit 50, through filter 44 and into conduit 52.

Conduit 52 opens into the interior of the housing 54 in which the compressor rotors and drive motor 56 are disposed, preferably downstream of the motor and upstream of the rotors. It will be noted that the fluid returned to the compressor is primarily in liquid form (some of the refrigerant portion of the fluid may be in gaseous form) and that the fluid returned to the compressor is returned downstream of the suction line 25 of compressor 10. Return of liquids to some compressors of other than the screw type can be fatal to survival of the compressor.

At the end of the drain portion of each oil return cycle, however long it might be in accordance with the then-existing pressure difference between condenser 16 and evaporator 20, controller 38 signals drain solenoid 40 to close and fill solenoid 42 to open. The closure of drain solenoid 40 isolates collection tank 32 from condenser pressure while the opening of fill solenoid 42 vents collection tank 32 to the interior of evaporator 20. As a result, the liquid pool at the bottom of evaporator 20 drains by force of gravity past check valve 30 into tank 32 until such time as the solenoids are next caused to reverse position so as to cause flushing of the contents of tank 32 back to compressor 12.

Efficiency of the oil return method and apparatus of the present invention can still further be optimized in an enhanced version of the preferred embodiment by varying the length of each oil return cycle in accordance with the then-existing actual load on the refrigeration system. By adding the third dimension of extending the overall length of individual oil return cycles when the system is operating under part load, parasitic losses to system efficiency as a result of the oil return process are further reduced as is the wear on the fill and drain solenoids. Oil return cycle times can be extended at low load conditions for the reason that the oil separators used in the refrigeration system of the present invention become even more efficient as the load on the system decreases. As such, not as great a percentage of oil escapes the oil separator and needs to be returned to the compressor.

Referring to FIGS. 3 and 4 and this further enhanced version of the preferred embodiment, the position of compressor slide valve 60 is sensed and communicated to controller 38 via communications line 62 which is shown in phantom. The position of slide valve 60 is determinative of the capacity of compressor 12 and is, in turn, determinative of system capacity. Slide valve 60 is controlled so as to be positioned in accordance with the instantaneous demand for capacity or load on the refrigeration system. In that way, the chiller system "works" only as hard as it needs to in order to meet the then-existing refrigeration "load" on the system.

As the load on the system changes and the change in load is sensed, the position of slide valve 60 is modulated to match the changing load. By monitoring slide valve position and communicating it to controller 38, an indication of the instantaneous load on the system is made available and can be factored into the oil-return methodology. It is to be noted that other system parameters can be sensed, compared and used to determine the load on a refrigeration system at any given time, including evaporator entering and leaving water temperatures, evaporator water flow and that the use of any of them or combinations of any of them to assist in the oil return process are likewise contemplated hereby.

Figure 7:
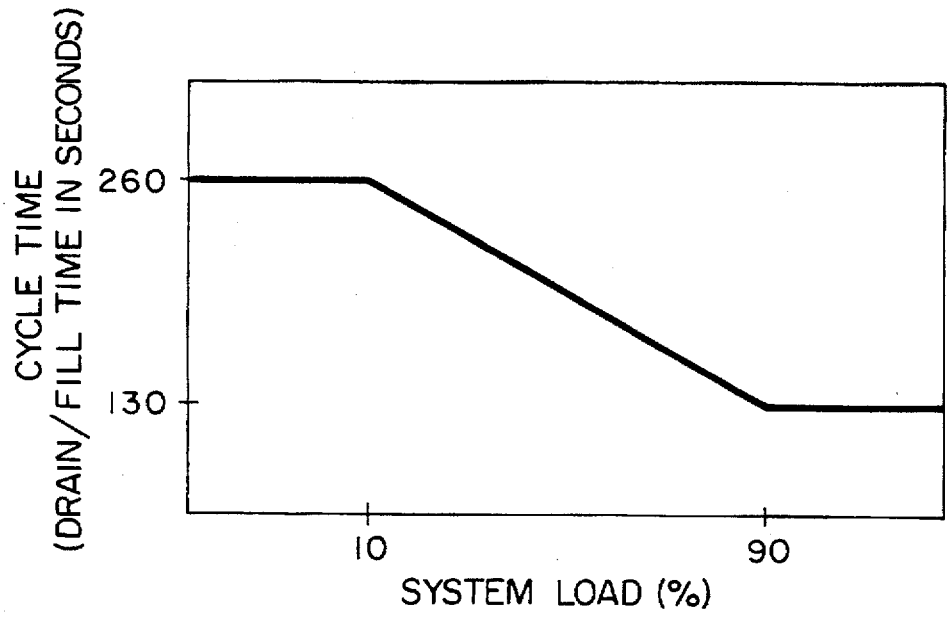
FIG. 7 graphically illustrates the length of an oil return cycle as a function of the load on the refrigeration system in an enhanced version of the present invention.

Referring now to FIG. 7, the effect of chiller load on the length of an oil return cycle in the enhanced version of the preferred embodiment is illustrated. It will be appreciated from FIG. 7 that in the preferred embodiment, where a one gallon collection tank is employed, the 130 second cycle time is maintained so long as the load on the refrigeration system is 90% or greater of system capacity. As the load on the system decreases, the length of an individual oil return cycle can be increased. In the case of the preferred embodiment, individual oil return cycles can be extended in length to as much as 260 seconds when the load on the system is 10% of capacity. It is to be noted that the screw compressor employed in the chiller system of the preferred embodiment is one which is capable of being unloaded to as low as 10% of its capacity and it will be appreciated that since a screw compressor is capable of being unloaded in a continuous fashion over its operating range, oil return cycle time can likewise be varied on a continuous basis as is indicated in FIG. 7.

Overall, by use of refrigerant gas at high-side pressure to drive oil from collection tank 32, by limiting the time to which collection tank 32 is exposed to high side pressure for flushing purposes in accordance with the pressure differential that exists between the system condenser and evaporator when flushing occurs and, if desired, by varying individual oil return cycle times in accordance with the then-existing load on the chiller system, very highly efficient oil return to the system compressor is achieved. At the same time, the adverse effect of the oil return process on system efficiency is minimized and the disadvantages associated with even the most efficient previous oil return systems are avoided.

Referring once again to FIGS. 3 and 4, it will be seen that by the use of an additional branch conduit (shown in phantom at 58 in FIGS. 3 and 4), a portion of the liquid collected in tank 32 (which consists primarily of liquid refrigerant) can be returned to distribution device 24 above to the evaporator tube bundle 26 in evaporator 20 for re-distribution thereto and heat transfer therewith. As such, the apparatus and method of the present invention can additionally or separately be employed to re-circulate liquid refrigerant which pools in the evaporator back to the tube bundle for heat transfer therewith. In some systems, a mechanical pump is used to do so which, once again, brings with it higher first costs and a continuing expense in the form of pump repair and maintenance.

A separate, dedicated system could likewise be employed using the pressure difference between condenser 16 and evaporator 20 to recirculate such liquid back to the distributor portion of the evaporator. Such a separate system might include its own collection tank and be controlled differently than is the case with respect to the arrangement identified above the primary purpose of which is to return lubricant to the system compressor.

While the present invention has been described in terms of a preferred and alternative embodiments, it will be appreciated that still other modifications thereto are contemplated and fall within the scope of the present invention. Also, it is to specifically be noted that while the present invention has been described in terms of oil return in a screw compressor-based refrigeration system, it likewise has application to refrigeration systems driven by other types of compressors, including those of the centrifugal type. It will also be noted that the source of pressure for flushing the collection tank need not be the condenser nor need the pressure be condenser pressure, only a pressure sourced from some location which is greater than evaporator pressure and sufficient to return lubricant to the compressor. As such, the scope of the present invention is not to be limited other than in accordance with the language of the claims which follow.

What is claimed is:

1. A refrigeration system comprising:

a compressor out of which compressed refrigerant gas issues, said refrigerant gas having compressor lubricant entrained within it;

a condenser, said condenser condensing refrigerant gas received from said compressor to liquid form;

a metering device, said metering device receiving condensed system refrigerant and compressor lubricant from said condenser;

an evaporator, said evaporator receiving condensed system refrigerant and compressor lubricant from said metering device, a first portion of said condensed refrigerant being vaporized within said evaporator and a second portion of said condensed refrigerant and said compressor lubricant pooling as a mixture in said evaporator; and means for returning said mixture to said compressor by exposing said mixture to a pressure greater than evaporator pressure, said exposure lasting for a period of time which is determined in accordance with the difference between evaporator pressure and said pressure which is greater than evaporator pressure.

2. The refrigeration system according to claim 1 wherein the source of pressure for returning said mixture to said compressor is said condenser and wherein said pressure which is greater than evaporator pressure is condenser pressure.

3. The refrigeration system according to claim 2 further comprising means for sensing a pressure internal of said condenser; means for sensing a pressure internal of said evaporator; and, control means, said control means determining the period of time said mixture is exposed to condenser pressure in accordance with the differential pressure sensed between said evaporator and said condenser.

4. The refrigeration system according to claim 3 wherein said means for returning includes a collection tank, said mixture passing from said evaporator into said collection tank, the portion of said mixture returned to said compressor by exposure to condenser pressure being returned from said collection tank.

5. The refrigeration system according to claim 4 wherein the return of said mixture to said compressor occurs in cycles, the length of a return cycle being determined in accordance with the then-existing load on said refrigeration system.

6. The refrigeration system according to claim 4 wherein said mixture in said collection tank is exposed to refrigerant gas sourced from said condenser, exposure of said mixture to said refrigerant gas sourced from said condenser terminating generally coincident with the emptying of said collection tank of said mixture so as to prevent the bypass of said evaporator by said gas sourced from said condenser other than to the extent necessary to empty said collection tank of said mixture.

7. The refrigeration system according to claim 4 wherein said compressor is a screw compressor and wherein return of said mixture to said compressor is downstream of the suction line of said compressor, said mixture consisting primarily of liquid refrigerant.

8. The refrigeration system according to claim 4 wherein said evaporator is a falling film evaporator, wherein refrigerant in its liquid state, refrigerant in its gaseous state and compressor lubricant is received by said evaporator from said metering device and further comprising means for separating refrigerant in its gaseous state from refrigerant in its liquid state, said separating means delivering liquid refrigerant and compressor lubricant to the interior of said evaporator for distribution and heat transfer therein.

9. The refrigeration system according to claim 1 wherein return of said mixture to said compressor occurs in cycles, the length of a cycle being determined in accordance with the then-existing load on said refrigeration system.

10. The refrigeration system according to claim 9 wherein said pressure greater than evaporator pressure is condenser pressure and wherein said mixture is returned to said compressor for a predetermined period of time within an individual return cycle, said period of time being determined in accordance with the then-existing differential pressure between said evaporator and said condenser.

11. The refrigeration system according to claim 9 wherein the length of said return cycles decrease as the load on said refrigeration system decreases.

12. The refrigeration system according to claim 9 wherein said means for returning includes a collection tank, said mixture passing from said evaporator into said collection tank, the portion of said mixture returned to said compressor during a return cycle being returned from said collection tank, said mixture in said collection tank being exposed to refrigerant gas sourced from said condenser, exposure of said mixture to said refrigerant gas sourced from said condenser terminating generally coincident with the emptying of said collection tank of said mixture so as to prevent the bypass of said evaporator by said gas sourced from said condenser other than to the extent necessary to empty said collection tank of said mixture.

13. The refrigeration system according to claim 9 further comprising:

means for sensing the load on said refrigeration system;

means for sensing condenser pressure;

means for sensing evaporator pressure; and means for controlling the return of said mixture to said compressor, the source of pressure for returning said mixture to said compressor being said condenser, said mixture being returned to said compressor for a predetermined period of time within a return cycle, said period of time being determined in accordance with the difference between sensed evaporator pressure and sensed condenser pressure.

14. The refrigeration system according to claim 9 wherein said compressor is a screw compressor, wherein return of said mixture to said compressor is downstream of the suction line of said compressor and wherein said mixture returned to said compressor consists primarily of liquid refrigerant.

15. A refrigeration system comprising:

a compressor out of which a stream of compressed refrigerant gas issues, said gas stream having compressor lubricant entrained within it;

a condenser;

an evaporator, said evaporator receiving refrigerant and lubricant from said condenser, a portion of said refrigerant and said lubricant pooling as a liquid mixture in said evaporator; and means for cyclically returning said mixture from said evaporator to said compressor, the length of an individual return cycle being determined in accordance with the then-existing load on said refrigeration system.

16. The refrigeration system according to claim 15 wherein said means for cyclically returning said mixture to said compressor includes means for exposing said lubricant to condenser pressure for a period of time which is determined in accordance with the difference between condenser pressure and evaporator pressure.

17. The refrigeration system according to claim 16 wherein said means for cyclically returning said mixture to said compressor includes a collection tank, said mixture passing from said evaporator into said collection tank, the portion of said mixture returned to said compressor being returned from said collection tank.

18. The refrigeration system according to claim 17 wherein said compressor is a screw compressor and wherein said mixture returned to said screw compressor consists primarily of liquid refrigerant.

19. The refrigeration system according to claim 18 wherein return of said mixture to said screw compressor is downstream of the suction line of said compressor.

20. The refrigeration system according to claim 19 wherein the length of said return cycles decrease as the load on said refrigeration system decreases.

21. A refrigeration system comprising;

a compressor out of which compressed refrigerant gas issues, said refrigerant gas having compressor lubricant entrained within it;

a condenser, said condenser condensing refrigerant gas received from said compressor to liquid form;

a metering device, said metering device receiving condensed system refrigerant and compressor lubricant from said condenser;

an evaporator, said evaporator receiving refrigerant in its gaseous state, refrigerant in its liquid state and compressor lubricant from said metering device, said liquid refrigerant being distributed within said evaporator to promote the transfer of heat from a heat transfer medium flowing through said evaporator to said refrigerant, a first portion of said refrigerant received in said evaporator in its liquid state being vaporized within said evaporator by heat exchange contact with said heat transfer medium and a second portion of said refrigerant received in said evaporator in its liquid state, together with compressor lubricant, pooling in the lower portion of said evaporator as a mixture of liquid refrigerant and compressor lubricant; and means for returning said mixture to a different location in said evaporator, from where said returned mixture is re-distributed for heat transfer with said heat transfer medium flowing through said evaporator, by exposing said mixture to a pressure higher than evaporator pressure.

22. The refrigeration system according to claim 21 wherein said means for returning includes a collection tank, said mixture passing from said evaporator into said collection tank prior to its return to said location in said evaporator, the mixture returned to said location in said evaporator for re-distribution therein being returned from said collection tank.

23. The refrigeration system according to claim 22 wherein the source of pressure for returning said mixture to said evaporator location is said condenser.

24. The refrigeration system according to claim 23 further comprising means for distributing liquid refrigerant within said evaporator, the location in said evaporator to which said mixture is returned being within said means for distributing liquid refrigerant within said evaporator.

25. The refrigeration system according to claim 24 further comprising means for separating refrigerant in its gaseous state from refrigerant in its liquid state, said means for separating being disposed downstream of said metering device, upstream of said means for distributing and in flow communication with both.

26. A method of returning lubricant carried out of a compressor in a refrigeration system in the stream of refrigerant gas discharged therefrom, where such lubricant tends to concentrate as a mixture of lubricant and refrigerant in the evaporator of said system, comprising the steps of:

sensing a pressure related to the condenser of said system;

sensing a pressure related to the evaporator of said system;

providing a flow path for said mixture back to said compressor;

exposing said mixture to a system pressure for a period of time determined in accordance with the difference between said sensed condenser-related pressure and said sensed evaporator-related pressure, said system pressure being sufficient to return said mixture back to said compressor.

27. The method of returning lubricant set forth in claim 26 wherein said return of lubricant to said compressor occurs in cycles and further comprising the step of sensing the load on said refrigeration system, said exposing step occurring once in an individual one of said return cycles, the length of an individual return cycle being determined in accordance with the sensed load on said refrigeration system.

28. The method according to claim 27 comprising the further step of directing said mixture to and collecting said mixture in a discrete housing, the portion of said mixture returned to said compressor during a return cycle being returned from said housing.

29. The method according to claim 28 wherein said condenser is the source of said system pressure.

30. The method according to claim 29 wherein said mixture is returned to said compressor in liquid form and downstream of the suction line of said compressor.

31. A method of cyclically returning lubricant carried out of a compressor in a refrigeration system in the stream of refrigerant gas discharged therefrom back to said compressor, where such lubricant tends to concentrate as a mixture of lubricant and refrigerant in the evaporator of said system, comprising the steps of:

determining the load on said refrigeration system;

defining the length of an individual return cycle in accordance with the then-existing load on said system; and exposing said mixture, for a period of time within said individual return cycle, to a system pressure sufficient to drive said mixture back to said compressor.

32. The method according to claim 31 wherein said returning step includes the step of controlling the period of time of exposure of said mixture to said system pressure within an individual return cycle in accordance with the then-existing difference in pressure between the system condenser and said system evaporator.

33. The method according to claim 32 wherein the system pressure to which said mixture is exposed is condenser pressure.

34. The method according to claim 33 comprising the further step of collecting a portion of said mixture in a discrete housing, condenser pressure being applied, during an individual return cycle, to the portion of said mixture interior of said housing.

35. A method of returning refrigerant which pools in liquid form in the evaporator of a refrigeration system, after having been distributed therein a first time for heat exchange contact with a heat transfer medium flowing therethrough, to a location in said evaporator from where said liquid refrigerant is redistributed for heat exchange contact with said heat transfer medium, comprising the steps of:

collecting said liquid refrigerant in a housing;

isolating the interior of said housing from the interior of said evaporator; and exposing said collected liquid refrigerant to a pressure sufficient to drive it to said location in said evaporator.

36. The method according to claim 35 wherein said step of exposing said collected refrigerant comprises the step of exposing said collected refrigerant to the pressure in the condenser of said system.

* * * * *